US008514140B1

(12) United States Patent
Rao et al.

(10) Patent No.: US 8,514,140 B1
(45) Date of Patent: Aug. 20, 2013

(54) DUAL-BAND ANTENNA USING HIGH/LOW EFFICIENCY FEED HORN FOR OPTIMAL RADIATION PATTERNS

(75) Inventors: Sudhakar K. Rao, Churchville, PA (US); Chih-Chien Hsu, Cherry Hill, NJ (US); Gerard J. Matyas, Bala Cynwyd, PA (US)

(73) Assignee: Lockheed Martin Corporation, Bethesda, MD (US)

( * ) Notice: Subject to any disclaimer, the term of this patent is extended or adjusted under 35 U.S.C. 154(b) by 640 days.

(21) Appl. No.: 12/713,145

(22) Filed: Feb. 25, 2010

Related U.S. Application Data

(60) Provisional application No. 61/168,464, filed on Apr. 10, 2009.

(51) Int. Cl.
*H01Q 13/00* (2006.01)

(52) U.S. Cl.
USPC ..... 343/786; 343/772; 343/781 CA

(58) Field of Classification Search
None
See application file for complete search history.

(56) References Cited

U.S. PATENT DOCUMENTS

| | | | | |
|---|---|---|---|---|
| 3,662,393 | A * | 5/1972 | Cohn | 343/786 |
| 4,792,814 | A * | 12/1988 | Ebisui | 343/786 |
| 6,384,795 | B1 * | 5/2002 | Bhattacharyya et al. | 343/786 |
| 6,795,034 | B2 | 9/2004 | Lyerly et al. | |
| 7,183,991 | B2 * | 2/2007 | Bhattacharyya et al. | 343/786 |
| 7,463,207 | B1 | 12/2008 | Rao et al. | |
| 7,737,903 | B1 * | 6/2010 | Rao et al. | 343/786 |
| 2002/0186174 | A1 * | 12/2002 | Matsumoto et al. | 343/786 |
| 2004/0041737 | A1 * | 3/2004 | Gothard et al. | 343/781 P |
| 2004/0070546 | A1 * | 4/2004 | Bhattacharyya et al. | 343/786 |
| 2008/0238798 | A1 * | 10/2008 | Kuo et al. | 343/786 |

OTHER PUBLICATIONS

"A New Horn Antenna with Suppressed Sidelobes and Equal Beamwidths", P.D. Potter, JPLTechnical Report No. 32-354; Feb. 25, 1963, pgs. 21 pages.*

* cited by examiner

*Primary Examiner* — Trinh Dinh
(74) *Attorney, Agent, or Firm* — McDermott Will & Emery LLP

(57) ABSTRACT

A dual-band antenna system configured to transmit and/or receive microwave beams over two or more frequency bands with substantially similar beam widths and substantially similar sidelobe levels is disclosed. The antenna system includes at least one reflector and at least one feed horn, the horn configured to provide a first efficiency over a first frequency band and lower efficiencies over one or more second frequency bands. The horn includes a substantially conical wall having an internal surface with a variable slope. The internal surface includes one or more slope discontinuities, wherein the slope discontinuities are configured to generate primarily TE1,*m* modes within the first frequency band and within the second frequency bands and generate TM1,*n* modes substantially only within the second frequency bands.

12 Claims, 8 Drawing Sheets

DUAL-BAND ANTENNA USING HIGH/LOW EFFICIENCY FEED HORN FOR OPTIMAL RADIATION PATTERNS

This application claims the benefit of priority under 35 U.S.C. §119 from U.S. Provisional Patent Application Ser. No. 61/168,464 entitled "DUAL-BAND ANTENNA USING HIGH/LOW EFFICIENCY FEED HORN FOR OPTIMAL RADIATION PATTERNS," filed Apr. 10, 2009, which is incorporated by reference in its entirety for all purposes.

STATEMENT REGARDING FEDERALLY SPONSORED RESEARCH OR DEVELOPMENT

Not applicable.

BACKGROUND

1. Field

The present disclosure generally relates to antennas and, in particular, relates to dual-band antennas using high/low efficiency feed horns for optimal radiation patterns.

2. Description of the Related Art

When communicating between widely separated locations where the time that it takes for a signal to travel the intervening distance is significant, one common approach to improving the bandwidth of the communication link is to use different frequencies for the signals traveling in each direction. This allows signals to be sent continuously in both directions without interference. Each frequency is actually a frequency band, with a bandwidth determined in part by whether the signal is a frequency modulation, requiring more bandwidth, and the practical frequency sensitivity of the transmitter and receivers. It can be advantageous to have a wide separation between the frequencies of these two communication bands. For a two-band system, the bandwidth ratio (BWR) is defined as the ratio of the highest frequency of the high band to the lowest frequency of the low band.

Multiple-beam antenna systems are increasingly being used for satellite communications. For example, multiple-beam antennas are currently being used for direct-broadcast satellites (DBS), personal communication satellites (PCS), military communication satellites, and high-speed Internet applications. These antennas provide mostly contiguous coverage over a specified field of view on Earth by using high-gain multiple spot beams for downlink (satellite-to-ground) and uplink (ground-to-satellite) coverage.

An antenna may be considered as a transformer that matches the impedance of a transmission line to the impedance of free space, 377 ohms Microwaves are electromagnetic waves with frequencies in the range of 300 MHz-300 GHz. A common microwave transmission line is a hollow line with a diameter of greater than a half wavelength and less than a full wavelength for the frequency of the signal that it carries. If a waveguide is left open-ended, the impedance of the line is not matched to that of free space and there is little gain. If the diameter of the waveguide is slowly expanded to a larger aperture, however, more gain can be realized while preventing undesired modes from reaching the waveguide. A funnel-like expansion of a circular waveguide is called a conical horn. A horn such as this is frequently used as the feed to a reflector antenna which shapes and steers the microwave beam or, for reception, collects a beam and feeds the microwaves into the horn.

The boundary conditions of a horn, including both the surfaces and discontinuities, may generate transverse modes for the electromagnetic field at the frequency of interest for the horn. Higher-level Transverse Electric (TE) fields tend to enhance the efficiency of a horn while Transverse Magnetic (TM) modes tend to reduce the efficiency. The mode numbers are usually indicated by suffix numbers such as TE11, TE12, etc., where multiple modes are referred to by use of "TE1,*m*" or "TE1,*n*" nomenclature.

Communication bands have been defined at many frequencies. Common bands include 12, 20, 25, 45, and 60 GHz bands. 45 GHz is a band commonly used by the military. Common combinations of frequency bands for bidirectional communication include 20 and 60 GHz (BWR=62/18=3.67) and 12 and 45 GHz (BWR=45.5/12.0=3.79).

Conventional multiple-beam satellite payloads employ separate uplink and downlink antenna suites. For example, the Anik-F2 satellite uses 5 uplink antennas in one antenna suite and 5 downlink antennas in another antenna suite, requiring 10 apertures. This is due to the lack of feed horns that can efficiently support both uplink and downlink frequencies that are widely separated. Each feed horn in the downlink antenna suit is capable of providing signal transmission over a selected transmission frequency band, whereas each feed horn in the uplink antenna suit is configured to provide signal reception over a required reception frequency band. These conventional multibeam satellites require several antenna apertures which consume valuable space on the spacecraft and are relatively expensive due to twice the number of reflectors and twice the number of feed horns required when compared to the dual-band antenna system disclosed herein.

Other conventional multiple-beam satellite payloads, such as AMC-15, AMC-16 and Rainbow, employ dual-band antennas using low-efficiency corrugated feed horns to realize dual-band operation, but have a significantly lower RF performance. Other conventional designs for a dual-band antenna may employ a frequency selective surface (FSS) subreflector, a low-frequency feed horn, a high-frequency feed horn, and a main reflector. The FSS subreflector employs resonant elements that are transparent to low frequencies and are reflective to high-frequency signals. Disadvantages with this approach include increased losses, the requirement of two separate feeds, a FSS subreflector, the complexity and consequent cost of the antenna, and narrow bandwidths.

Another design for a dual-band antenna involves the use of a coaxial feed horn, wherein the central horn works at the high-frequency band using waveguide modes and the outer horn works in the lower-frequency band in the coaxial mode. Disadvantages with this approach include high cross-polar levels due to coaxial modes, strong mutual coupling of signals between low and high frequency bands, and narrower bandwidth of operation.

SUMMARY

This disclosure describes the design of antenna systems and, in particular, feed horns that can transmit and receive signals in two or more widely separated frequency bands within the microwave frequency range. The antenna systems and horns have substantially the same angular beam widths in all frequency bands which reduces the pointing requirement of the antenna system compared to a two-band antenna system that has a narrower angular beam width at the higher frequency band than at the lower frequency band. This is achieved in certain embodiments by the use of slope discontinuities in a smooth-walled conical horn. The diameters and positions of the slope discontinuities are selected to produce TE modes in all frequency bands while producing TM modes primarily in the higher frequency bands and few TM modes at lower frequency bands. The TM modes reduce the efficiency of the horn at the higher frequencies and consequently widen the angular beam widths of the higher frequency bands to match angular beam width of the lowest frequency band.

According to certain embodiments, a dual-band antenna system configured to transmit and/or receive simultaneously radio beams over at least two frequency bands with substantially similar beam widths and substantially similar sidelobe levels is disclosed. The antenna system includes at least one reflector and at least one feed horn. The horn is configured to provide a first efficiency over a first frequency band and lower efficiencies over one or more second frequency bands. The horn has a substantially conical wall having an internal surface with a variable slope. The internal surface includes one or more slope discontinuities that generate TE1,*m* modes within the first frequency band and the second frequency bands and generate TE1,*n* modes substantially only within the second frequency bands.

According to certain embodiments, a dual-band feed horn for an antenna system configured to transmit and/or receive radio beams over at least two frequency bands with substantially similar beam widths and substantially similar sidelobe levels is disclosed. The horn has a first opening, a first region connected to the first opening, the first region including a substantially cylindrical wall, a second region connected to the first region, the second region including a substantially conical wall, and a second opening connected to the second region. The horn has an axis extending from the first opening to the second opening. The second internal surface includes one or more tapered surface regions, each of the tapered surface regions having a slope greater than zero and less than ninety degrees with respect to the axis. Adjacent tapered surface regions are connected by slope discontinuities, wherein the positions and diameters of the slope discontinuities are configured to generate TE1,*m* modes within the first frequency band and within the second frequency bands and generate TE1,*n* modes substantially only within the second frequency bands.

According to certain exemplary embodiments of the subject disclosure, a dual-band antenna is disclosed using a high/low efficiency feed horn configured to operate over a low-end band of 18-21 GHz and over a high-end band of 57-64 GHz. This represents a BWR of approximately 3.56, representing a significant improvement in other dual-band antenna designs that have a BWR of less than 2.0. Moreover, this design can also support multiple frequency bands within the 18 GHz to 64 GHz range while maintaining the beam widths of the reflector antenna to be similar at all the frequency bands despite the large variation in the frequency bands.

In the following description, specific embodiments are described to shown by way of illustration how the invention may be practiced. It is to be understood that other embodiments may be utilized and changes may be made without departing from the scope of the present invention.

DETAILED DESCRIPTION

To overcome at least some of the disadvantages of existing dual-band antennas listed above, there is a need for an inexpensive antenna solution that works over two widely separated frequency bands. In addition, it is desirable that the co-polar radiation patterns of the antenna at the high frequency and at the low frequency be substantially the same to simplify the pointing requirements of the antenna system to maintain the communication link.

The present disclosure is made with examples of a single-offset reflector antenna and a Cassegrain dual-reflector antenna, both using a single dual-band feed horn. It will become apparent, however, that the concepts described herein are applicable to antenna systems of other types and configurations.

Horn antennas are frequently used as feed horns in reflector antenna systems. The generation of TE modes in a conical horn was discussed in U.S. Pat. No. 7,463,207 and this non-essential matter is incorporated herein by reference. The efficiency of a smooth-walled horn can be adjusted through the incorporation of circularly symmetric discontinuities in the wall, referred to as "slope-discontinuities", along the axis of the horn. The realization of high efficiency at both frequency bands, that are separated by a bandwidth ratio of about 1.6, in a dual-band horn using slope-discontinuities in a smooth-walled horn was also discussed in U.S. Pat. No. 7,463,207. These slope-discontinuities may be chosen to generate mostly TE1,*m* modes (TE12, TE13, TE14, TE15, etc. in addition to the dominant TE11 mode in a circular horn) at both bands in order to make aperture illumination more uniform to achieve desired high efficiency at both bands. When used as a feed with a reflector antenna, this feed provides different tapers at the reflector edges and therefore realizes different sidelobe levels (typically lower sidelobe levels at the high band). This approach can achieve a BWR of up to approximately 1.6. The beam width of the antenna varies with frequency over the two bands by the BWR.

Figure 1:
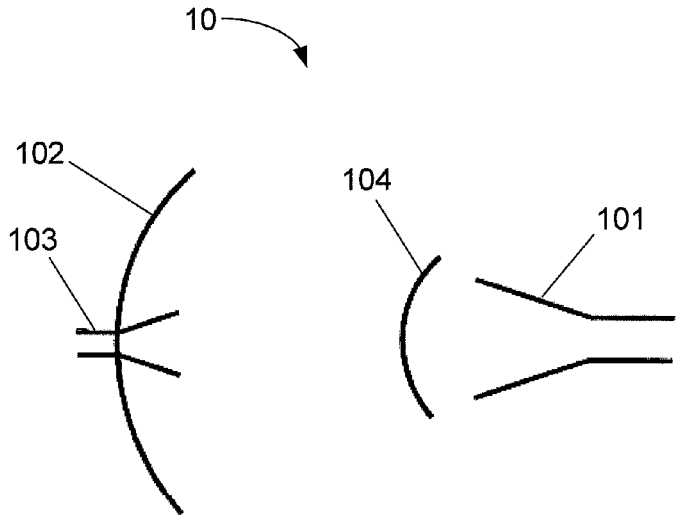
FIG. 1 illustrates a conventional dual-feed antenna with a frequency selective surface.

FIG. 1 illustrates a conventional dual-feed antenna 10 with a frequency selective surface (FSS) 104. Antenna system 10 comprises two separate feeds: a low-frequency feed 101 and a high-frequency feed 103. Reflector 102 is reflective at all frequencies while FSS 104 is relatively reflective at the frequencies of feed 103 and relatively transparent at the frequencies of feed 101. Signals from feed 101 pass through FSS 104 and are reflected by reflector 102. Signals from feed 103 are reflected from FSS 154 and then again reflected by reflector 102. As FSS 104 is not perfectly reflective at the frequencies of feed 103, some of the signal from feed 103 passes through or is absorbed by FSS 104. Similarly, as FSS 104 is not perfectly transparent at the frequencies of feed 101, some of the signal from feed 101 is reflected or absorbed by FSS 104. Both cases lead to increased loss in the system compared to a system without a FSS. The design of a FSS system is more complex and limited to a narrower bandwidth due to the need for two separate feeds 101 and 103, the additional element of FSS 104. The additional structure to mount two feeds 101 and 103 and FSS 104 increase the weight and cost of the system. This system produces beams whose width varies inversely with frequency.

Figure 2:
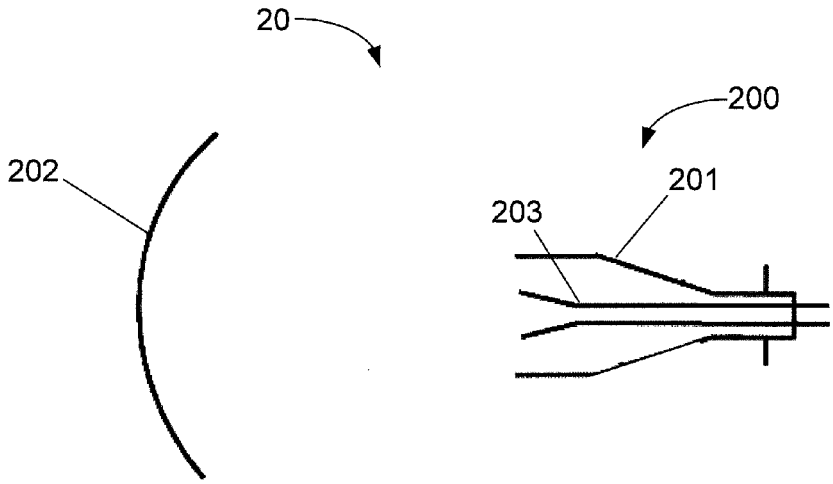
FIG. 2 illustrates a conventional dual-feed antenna with a coaxial feed.

FIG. 2 illustrates a conventional dual-feed antenna 20 with a coaxial feed 200 and a single reflector 202. The outer horn 201 operates in the lower frequency band in a co-axial mode while the inner horn 203 operates in the higher frequency band in a waveguide mode. The disadvantages of this approach are high cross-polar levels due to the co-axial modes, strong mutual coupling of signals between the low-frequency and high-frequency bands, and a narrow bandwidth of operation.

Figure 3:
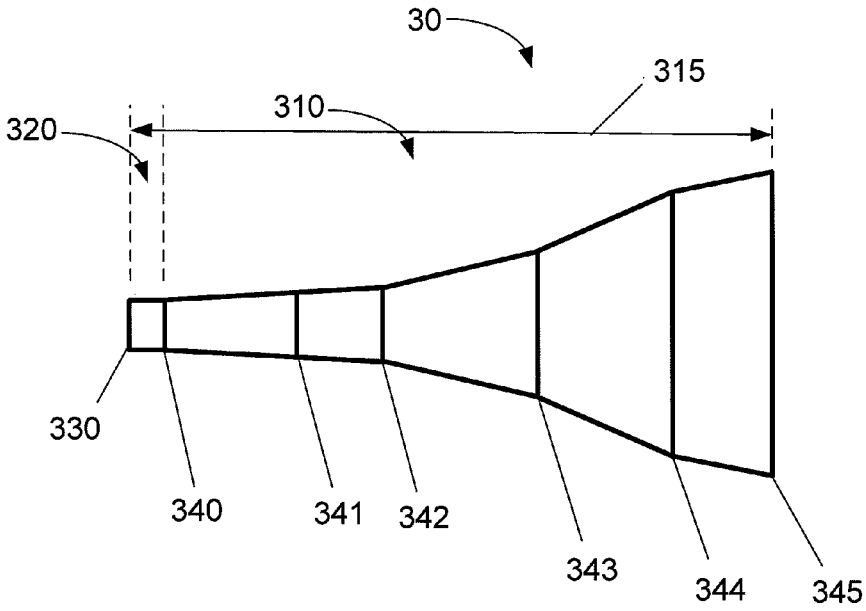
FIG. 3 illustrates a mechanism of generating desired higher-order modes using slope discontinuities within the feed horn according to certain aspects of the present disclosure.

FIG. 3 illustrates a mechanism of generating desired higher-order modes using slope discontinuities within the feed horn 30 according to certain aspects of the present disclosure. In this example, two frequency bands are defined at 18-21 GHz and 57-64 GHz. While this example is based on two frequency bands for simplicity of explanation, the same principles can be used to provide an antenna and feed horn operating at three or more bands.

Feed horn 30, in this example, is an axially symmetric flared horn illustrated herein as a cross-section profile along the axis of symmetry. Horn 30 has two regions 310 and 320. Region 320 is approximately a cylinder and region 310 is approximately a truncated cone. The two regions are connected at a breakpoint 340 and both regions have approximately smooth inner surfaces. Connection of a waveguide to horn 30 is accomplished at opening 330 whose diameter is sized to match the waveguide. The length of region 320 is selected to propagate the primary mode TE11 of the low-frequency band. Region 310 tapers from the diameter of breakpoint 340 to the horn aperture 354 where the diameter of aperture 345 and the overall length 315 from opening 330 to aperture 345 are selected at least in part based on the low-frequency bandwidth and desired efficiency. For this example with a low frequency band of 18-21 GHz, the nominal diameter of aperture 345 is 2.5 inches and the nominal overall length 315 is 6.25 inches. This starting design was refined during the optimization process described in FIG. 5 to reach the final length and aperture listed for aperture 345 in Table 1 below.

When used as a feed in a dual-band reflector antenna, horn 30 will illuminate several sidelobes over the reflector resulting in different sidelobe structures at the two frequency bands. These different radiation patterns lead to different angular beam widths, beam width being defined as the angle at which the signal strength drops a defined amount, typically 3 dB, from the peak value. In order to maintain the same radiation patterns for the two frequency bands, and therefore equivalent beam widths, the efficiency of the high band should be very low, typically less than 10%, while the efficiency of the low band should be much higher, typically greater than 65%. Low efficiency at the high band can be achieved if TE1,*n* modes (TM11, TM12, TM13, etc.) are primarily generated in the high band which will create a more tapered illumination at aperture 345. High efficiency in the low band can be achieved if primarily higher-order TE1,*m* modes (TE12, TE13, TE14, etc.) are generated in the low band to achieve more uniform illumination at aperture 345. It may not be possible to completely avoid generating TM modes in the lowest frequency band, reducing the efficiency achievable at the low frequency with this configuration of horn compared to a single-frequency horn.

This example includes four slope discontinuities 341, 342, 343, and 344 spaced between breakpoint 340 and aperture 345. The surfaces between slope discontinuities are smooth and tapered with an angle from the centerline axis-of-symmetry of the horn that is more than zero and less than ninety degrees. The diameters and positions of each slope discontinuity along length 315 determine which TE and TM modes are created at that slope discontinuity.

Table 1 discloses a range of values for the diameters and positions of the features of the horn of FIG. 3 for the frequency bands of 18-21 GHz and 57-64 GHz. Values in this range can be used as a starting point in the design process described in FIG. 5.

TABLE 1

| feature label | diameter range (in.) | position range (in.) |
|---|---|---|
| 330 | 0.39-0.47 | 0.000 |
| 340 | 0.39-0.47 | 0.18-0.22 |
| 341 | 0.40-0.61 | 1.26-1.54 |
| 342 | 0.56-0.68 | 2.27-2.77 |
| 343 | 1.10-1.34 | 3.57-4.35 |
| 344 | 1.97-2.39 | 4.78-5.82 |
| 345 | 2.24-2.72 | 5.66-6.91 |

Figure 5:
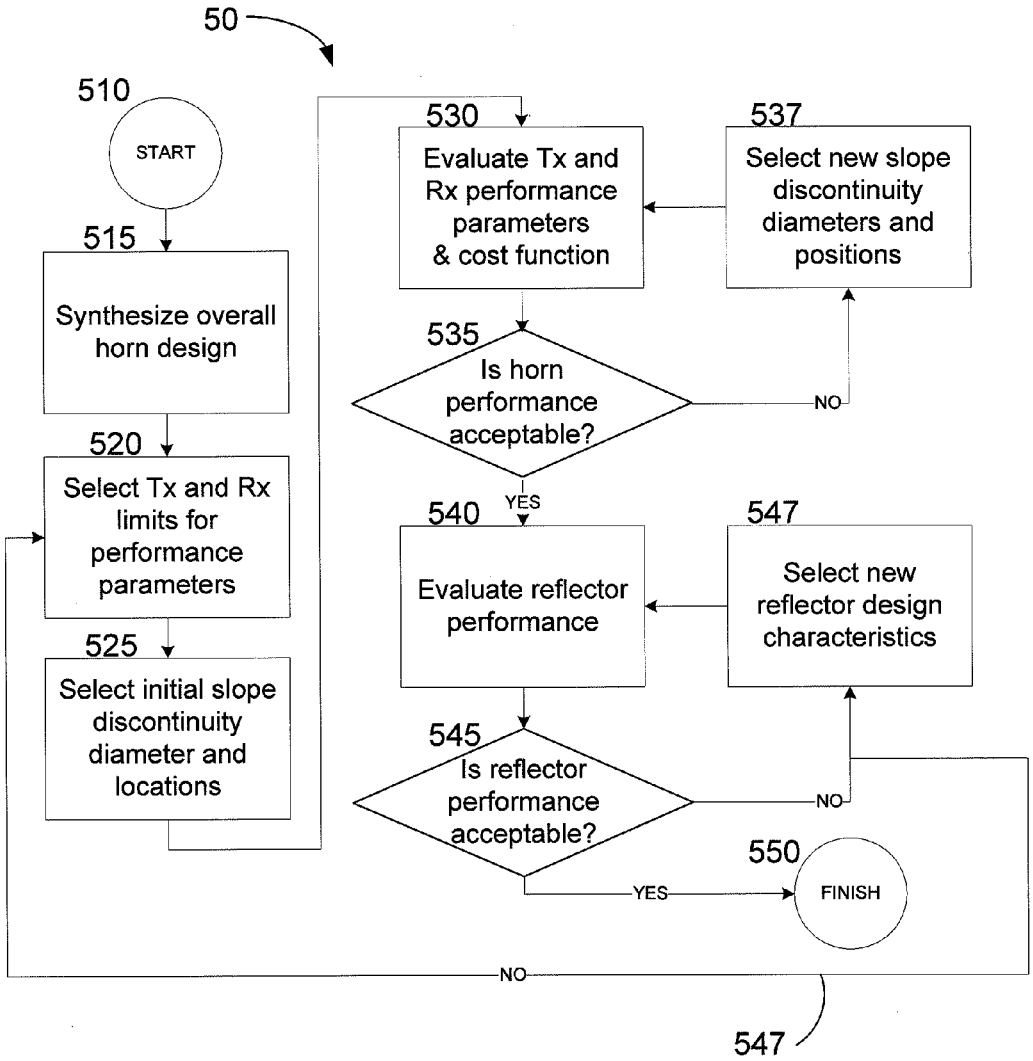
FIG. 5 illustrates a flowchart of the design of a dual-band antenna system according to certain aspects of the present disclosure.

Table 2 describes the final geometry of example horn 30 arrived at through the optimization process of FIG. 5 as well as the modes generated at each slope discontinuity. According to certain embodiments of the disclosure, opening 330 and aperture 345 are each viewed as one of the slope discontinuities. According to certain other embodiments of the disclosure, opening 330 and aperture 345 are not viewed as one of the slope discontinuities.

TABLE 2

| feature label | diameter (in.) | position (in.) | low freq. band | high freq. band |
|---|---|---|---|---|
| 330 | 0.430 | 0.000 | TE11 | TE11 |
| 340 | 0.430 | 0.200 | | TE12, TE13, TM12 |
| 341 | 0.554 | 1.400 | | TM13 |
| 342 | 0.616 | 2.521 | TE12, TM11 | TE14, TE15, TM15 |
| 343 | 1.221 | 3.959 | TE13, TM12, TM13 | |
| 344 | 2.181 | 5.298 | TE14 | TE16, TM16 |
| 345 | 2.480 | 6.288 | | |

Region 320 produces the dominant TE11 mode in both frequency bands and this is listed in Table 2 for feature label 330. Breakpoint 340 and slope discontinuities 341-344 produce the TE and TM modes as listed under each frequency band. Whether a particular slope discontinuity produces TE modes or TM modes or both is affected by the adjacent slopes and the diameter of the slope discontinuity relative to the frequency. Lower slope angles tend to produce TE modes while higher slopes tend to produce TM modes.

It can be seen that more TM modes are created in the high-frequency band than in the low-frequency band. The efficiency of the higher frequency band is reduced by both the direct effect of the TM mode and the increase in phase nonuniformity caused by the TM modes, as the non-uniform phase will also reduce the efficiency of the horn.

Figure 4:
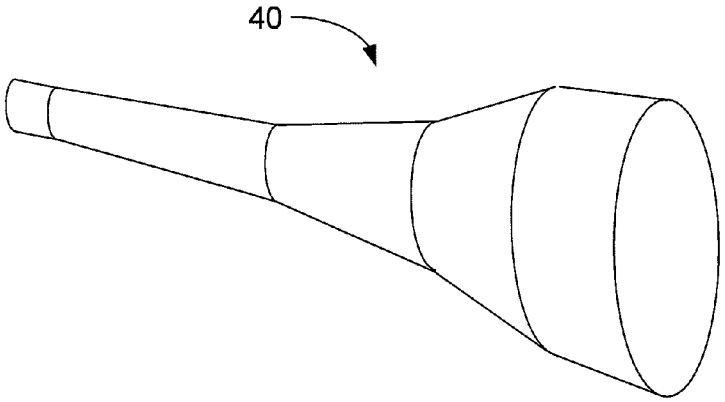
FIG. 4 shows a dual-band feed horn manufactured according to the principles described in FIG. 3.

FIG. 4 shows a dual-band feed horn manufactured according to the principles described in FIG. 3. The axial symmetry of this example and the smooth surfaces both inside and outside simplify the construction and produce a lightweight horn, with the slope discontinuities providing structural stiffness in addition to their radio frequency (RF) performance features.

FIG. 5 illustrates a flowchart 50 of the design process of a dual-band antenna system according to certain aspects of the present disclosure. Starting at step 510, the overall horn configuration is selected in step 515 based on at least some aspects of the low frequency band, physical constraints, and the nominal antenna configuration. In step 520, the minimum or maximum limits for performance parameters of efficiency, return loss, and cross-polar coupling are selected. The low-frequency efficiency will typically have a minimum limit while the high-frequency gain will typically have a maximum limit. The number of slope discontinuities and their positions and diameters are selected in step 525. For the example of FIG. 3, it was decided to have four slope discontinuities. The performance parameters are calculated using, in certain embodiments, a method of moments (MoM) technique and mode-matching software. In certain embodiments, an overall cost function is created wherein the difference between the predicted value of each performance parameter for a particular model and its threshold value is squared, multiplied by a weighting factor, and then summed to generate a single-value score for that particular model. Different models, constructed with different positions and diameters of the slope discontinuities, can then be easily compared and ranked using this score. According to certain embodiments, the value of the weighted term in the cost function is set to zero for each parameter that exceeds its threshold value (which may be either below a maximum or above a minimum threshold). According to certain embodiments, the performance parameters may be calculated at a single frequency in each band or at three, five or more frequencies across each band depending on, for example, the width of the frequency band and the design of the complete antenna system.

It is unlikely that the initial values of the positions and diameters of the slope discontinuities will generate satisfactory performance of the horn 30. If the performance of the horn is not satisfactory, decision block 535 will branch along the 'no' line to step 537 where a new set of positions and diameters is selected. This selection may be done using any of a number of optimization methods known to those of ordinary skill in the art, including "gradient search" and "monte carlo" techniques. The calculation of the performance parameters will be repeated in step 530 and the horn performance again assessed in decision block 535. If a configuration of slope discontinuity positions and diameters is found that meet all of the criteria defined in step 520, then block 535 will branch to step 540 where the final horn design is integrated into a model of the antenna which includes one or more reflectors.

In a manner similar to the horn design, the antenna performance is calculated and compared to one or more criteria in step 540. If the antenna does not meet the requirements, the process branches to step 547 where the design characteristics of the reflector elements are changed and the antenna performance evaluation repeated in step 540. This loop iterates until the antenna performance is satisfactory. In the case where a feed horn design has met every requirement but a satisfactory antenna design cannot be found, the process may alternately branch on line 547 back to step 520 to select new limits for the horn design and the process repeated to generate a new horn design with different attributes that will hopefully lead to a successful antenna design. When an antenna design is found that meets all criteria, decision block 545 branches to step 550 and the process is complete.

Table 3 shows the predicted performance parameters of the example dual-band horn of FIG. 3 after completing the optimization process of FIG. 5. In this example, the minimum efficiency for the 18-21 GHz band was selected to be 63% while the maximum efficiency for the 57-64 GHz band was selected to be 11%. Return loss for the high-frequency band was set as a minimum of 28 dB, and the minimum co-polar/cross-polar ratio (min C/X in Table 2) was set to 20 dB.

TABLE 3

| frequency (GHz) | return loss (dB) | efficiency (%) | peak gain (dBi) | min C/X @ 3dB BW (dB) | max AR @ 3dB BW (3 dB BW) | bandwidth (BW) @ 3dB (degrees) |
|---|---|---|---|---|---|---|
| 18 | 29.7 | 69.9 | 19.9 | 22.7 | 1.28 | 17.1 |
| 19.5 | 34.8 | 67.6 | 20.5 | 22.1 | 1.37 | 16.0 |
| 21 | 41.2 | 64.8 | 21.0 | 23.2 | 1.20 | 15.0 |
| 57 | 50.2 | 10.6 | 21.8 | 22.5 | 1.31 | 15.6 |
| 60 | 52.7 | 9.2 | 21.6 | 24.6 | 1.02 | 15.0 |
| 64 | 37.2 | 9.7 | 22.4 | 25.7 | 0.90 | 14.6 |

Figure 6:
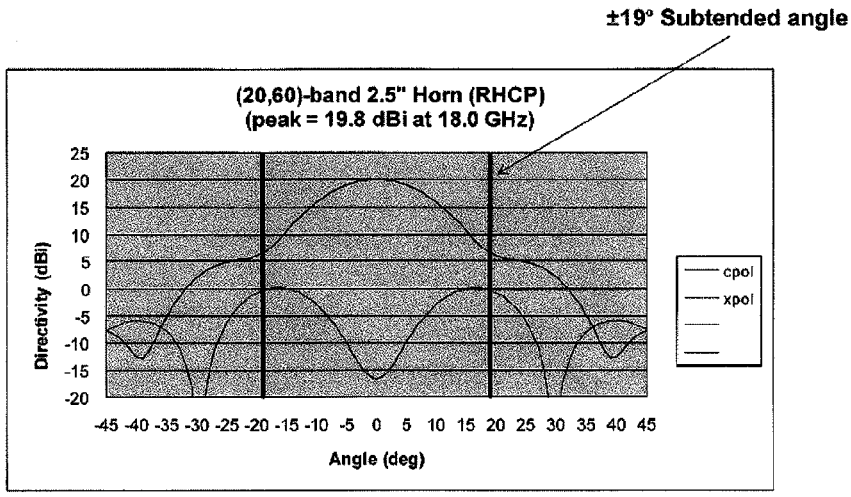
FIGS. 6-8 show the predicted directivity of the dual-band horn of FIG. 3 at 18, 19.5, and 21 GHz.
Figure 7:
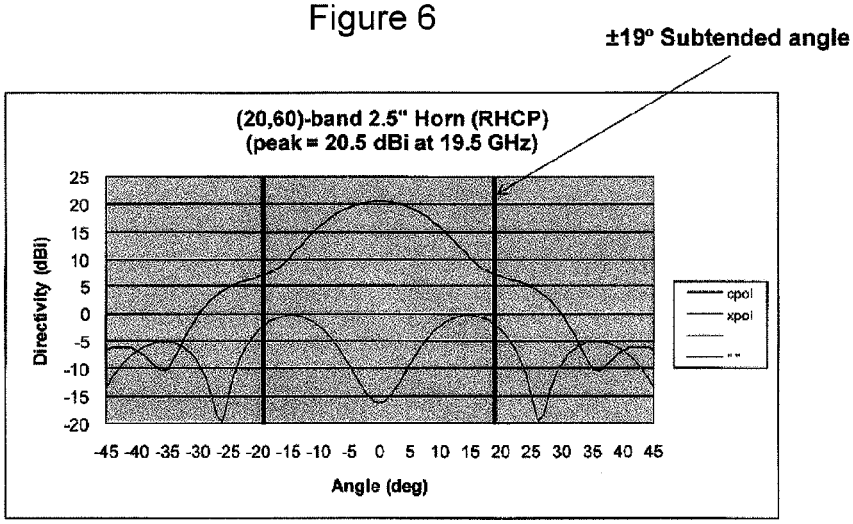
Figure 8:
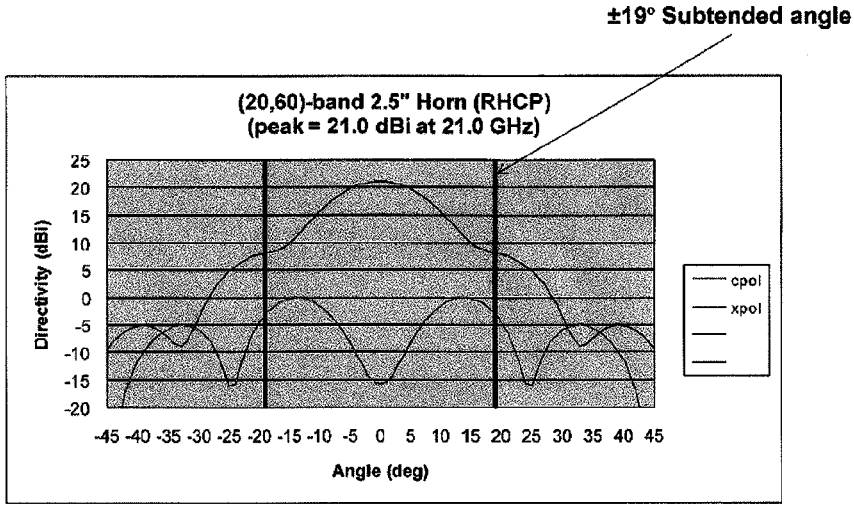

FIGS. 6-8 show the predicted directivity of the dual-band horn of FIG. 3 at 18.0, 19.5, and 21.0 GHz. The upper line is the co-polar radiation pattern while the lower line is the cross-polar radiation pattern. It can been seen that the values of 'peak gain' of Table 3 correspond to the peak value of the co-polar radiation pattern in each figure. The 'min C/X' parameter of Table 3 is the difference between the co-polar and cross-polar lines at the point where the co-polar line has dropped 3 dB from its peak value. The axial ratio (AR) is the variation in the signal if a linearly polarized antenna is used on the ground and rotated 360 degrees in phi angle at a given theta angle. Theta and phi angles are parameters of a spherical polar coordinate system that can be related to an X-Y-Z coordinate system by considering the X-Y plane as, in this case, the plane of the ground with the Z-axis projecting perpendicularly upwards from the X-Y ground plane. The theta angle is the angle of inclination of the antenna axis from the Z-axis (0 degrees would be pointed straight up) and the phi angle is the rotation of the antenna axis about the Z-axis from an arbitrary starting position (360 degrees of rotation describes a complete circle). The AR indicates quality of the circularly polarized antenna and is directly related to the cross-polar isolation (C/X) of the antenna. In this table, the maximum elimination angle, 'max AR', is defined by the 3 dB beam width. The combination of the return loss and the frequency produce the efficiency at each frequency, such that similar return losses produce different efficiencies at different frequencies. The bars marked '+/−19 degree subtended angle' represent the illumination angle at the edge of the reflector in the examples of a single reflector antenna and edge of the subreflector in a dual-reflector antenna shown in FIGS. 14 and 15.

Figure 9:
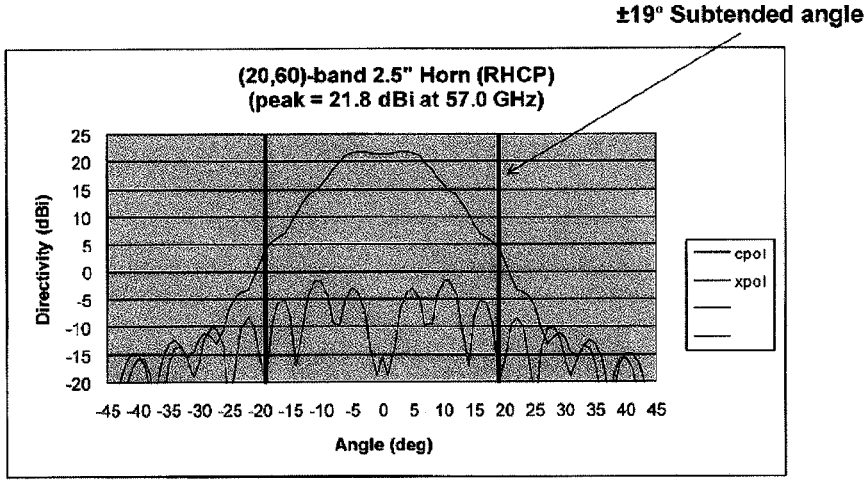
FIGS. 9-11 show the predicted directivity of the dual-band horn of FIG. 3 at 57, 60, and 64 GHz.
Figure 10:
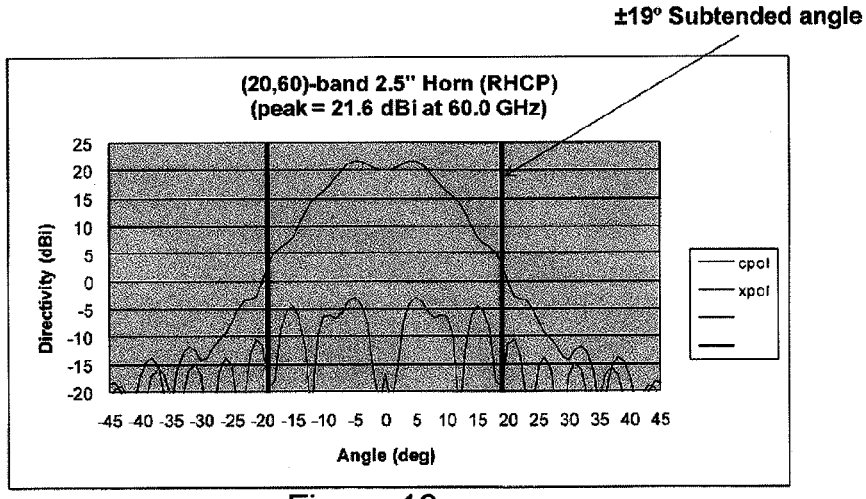
Figure 11:
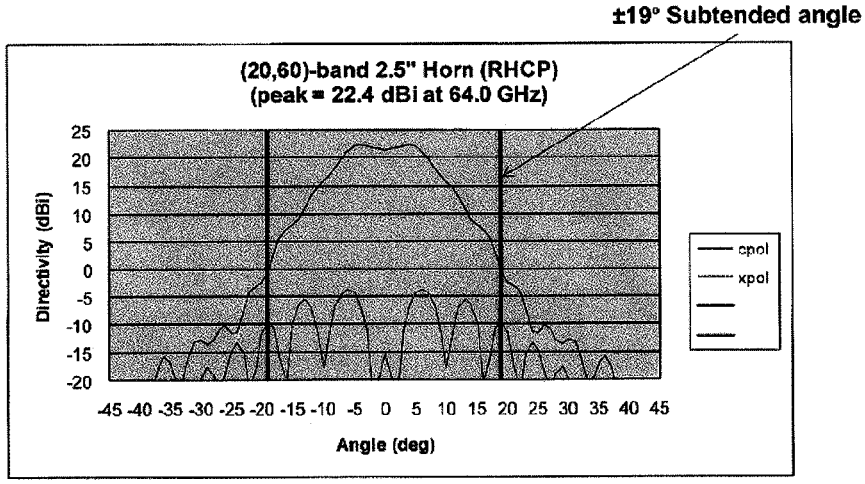

FIGS. 9-11 show the predicted co-polar and cross-polar radiation pattern of the dual-band horn of FIG. 3 at 57.0, 60.0, and 64.0 GHz. It can be seen that the peak gains are higher than 20 dBi while the cross-polar values are below 0 dBi, similar to those in the 18-21 GHz band as shown in FIGS. 6-8. Also as present in FIGS. 6-8, the bars marked '+/−19 degree subtended angle' represent the illumination angle of the antenna designs of FIGS. 14 and 15.

Figure 12:
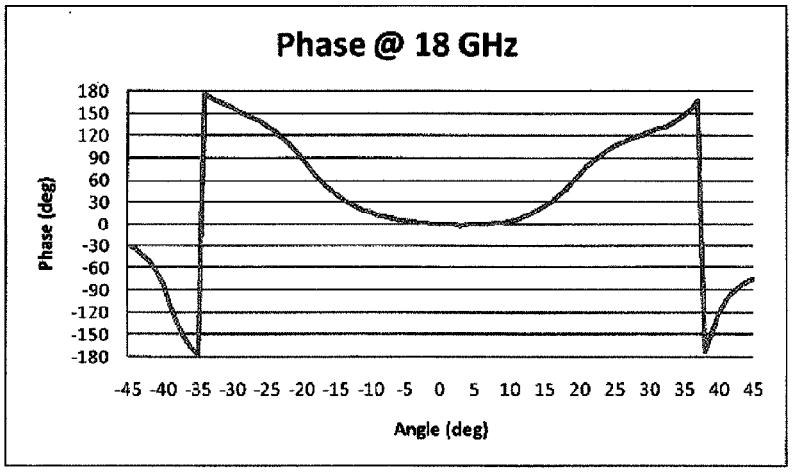
FIGS. 12-13 show the predicted phase of the dual-band horn of FIG. 3 at 18 and 60 GHz.
Figure 13:
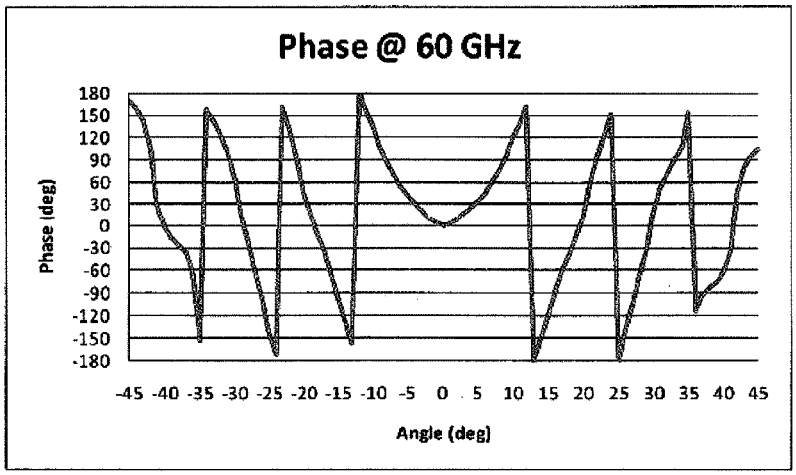

FIGS. 12-13 show the predicted phase of the dual-band horn of FIG. 3 at 18.0 and 60.0 GHz. The phase variation at 18 GHz remains below 90 degrees out to approximately +/−20 degrees of angle, which contributes to high efficiency. FIG. 13, by comparison, shows significantly larger phase variation at 60 GHz, surpassing 360 degrees at the edge of the illumination angle, which will result in a broader secondary beam of the antenna system. This is desirable at the higher frequency as the goals are to achieve a broader primary beam from the horn and low efficiency.

Figure 14:
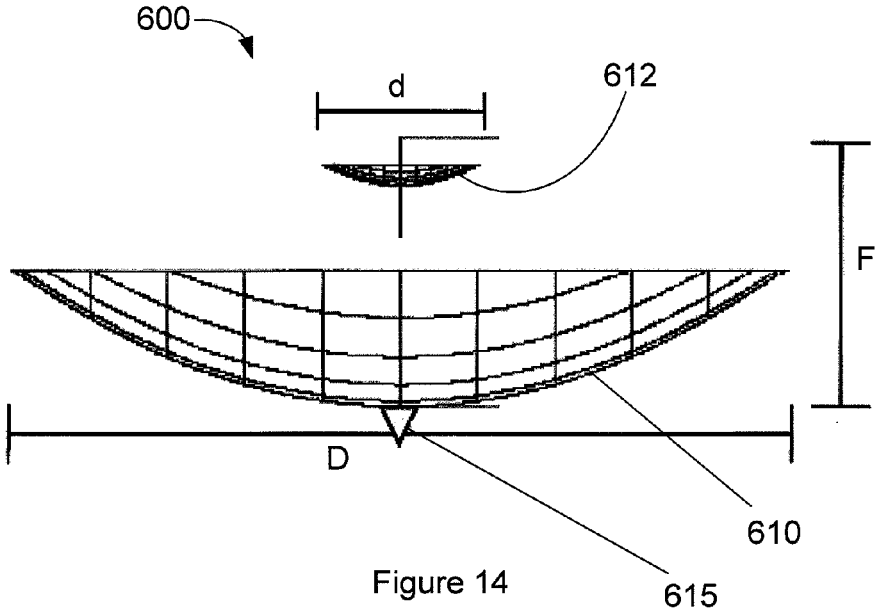
FIG. 14 illustrates a Cassegrain dual reflector antenna system with a dual-feed horn according to certain aspects of the present disclosure.

FIG. 14 illustrates a Cassegrain dual reflector 600 with a dual-feed horn 615 according to certain aspects of the present disclosure. The signal path is from the dual-feed horn 615 to the secondary reflector 612 and then to the primary reflector 610. The primary reflector has a diameter 'D', the secondary reflector a diameter 'd', and the main reflector is separated from the focal point of the secondary reflector by separation 'F', the values of which are listed in Table 4. The design of this antenna is done according to standard practices known to those of ordinary skill in the art.

TABLE 4

| Parameter name (from FIG. 14) | value (meters) |
|---|---|
| D | 2.0 |
| d | 0.4 |
| F | 0.7 |

The angle from the feed horn 615 to the edges of the subreflector 612 defines the maximum illumination angle. The choice of an illumination angle is part of the antenna design process and is a tradeoff between, among other factors, the required pointing performance of the antenna system and the beam strength. This exemplary antenna configuration has a 19 degree illumination angle. The variation of the signal strength across this illumination angle is called the illumination taper, defined as the decrease in signal strength from the peak value to the value at the edge of the illumination angle. Illumination tapers of 13-20 dB are desirable.

Figure 15:
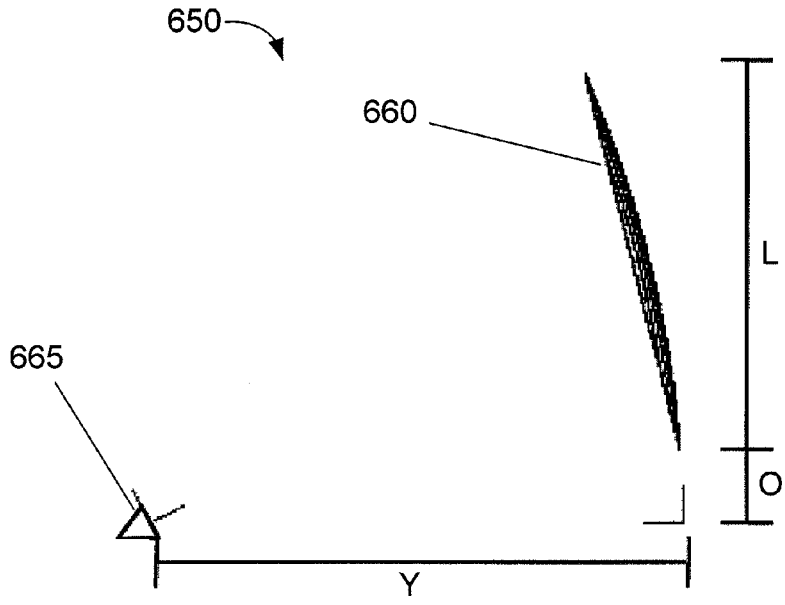
FIG. 15 illustrates a single-offset reflector antenna system with a dual-feed horn according to certain aspects of the present disclosure.

FIG. 15 illustrates a single-offset reflector 650 with a dual-feed horn 665 according to certain aspects of the present disclosure. Reflector 660 is offset from the location of dual-feed horn 665 by distance O and separated from the horn 665 by a distance Y, the values of which are listed in Table 5. The design of this antenna is done according to standard practices known to those of ordinary skill in the art.

TABLE 5

| Parameter name (from FIG. 15) | value (meters) |
|---|---|
| L | 2.0 |
| O | 0.4 |
| Y | 2.8 |

Figure 16:
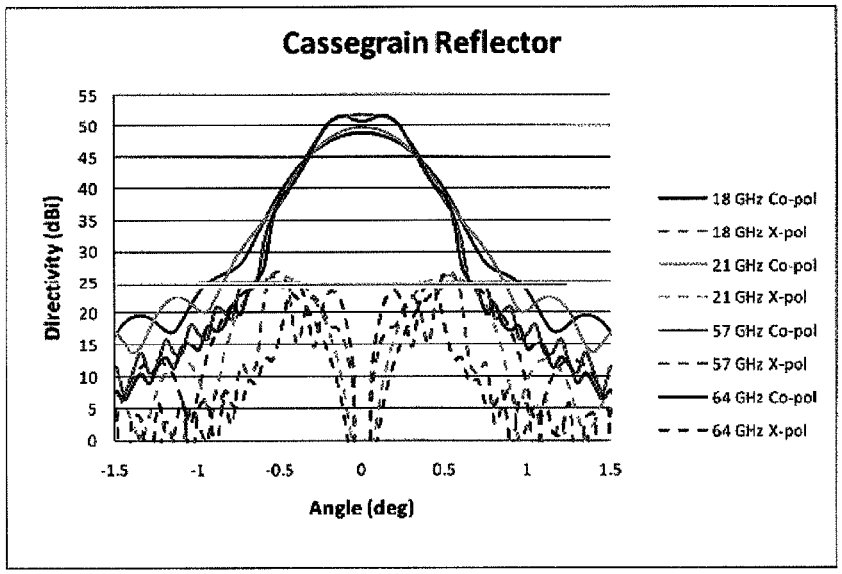
FIG. 16 shows the co-polar and cross-polar radiation patterns at 18, 21, 57, and 64 GHz of the Cassegrain antenna of FIG. 14.

FIG. 16 shows the predicted co-polar and cross-polar radiation patterns at 18, 21, 57, and 64 GHz of the Cassegrain antenna 600 of FIG. 14. It can be seen that the co-polar beam patterns are well matched at all frequencies and approximately above 40 dBi across a beam of +/−0.5 degrees. The secondary co-polar radiation beam strengths at all frequencies are approximately below 30 dBi at this same beam width.

Figure 17:
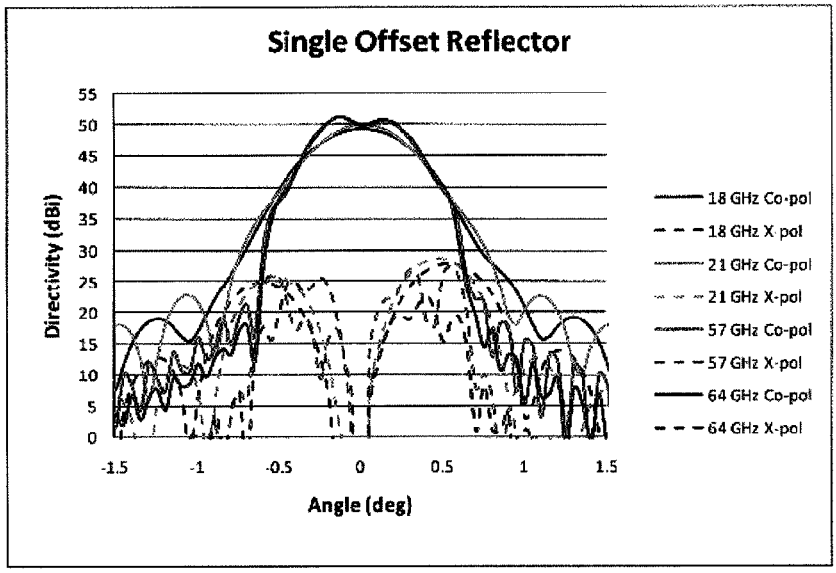
FIG. 17 shows the co-polar and cross-polar radiation patterns at 18, 21, 57, and 64 GHz of the single-offset antenna of FIG. 15.

FIG. 17 shows the predicted co-polar and cross-polar radiation patterns at 18, 21, 57, and 64 GHz of the single-offset antenna 650 of FIG. 15. The co-polar and cross-polar radiation patterns of this antenna 650 are similar to those of the Cassegrain reflector 600 across +/−0.5 degrees, being approximately above 46 dBi and below 28 dBi respectively.

In summary, a novel and inexpensive antenna solution that works over two widely separated frequency bands with optimized radiation patterns across both frequency bands is disclosed. The disclosed antenna systems employ a feed horn that has high efficiency over a low frequency band and low efficiency over a high frequency band. Such a horn provides almost identical illumination taper at the aperture across both frequency bands and thus illuminates the reflector with optimal taper at both bands, providing substantially identical beam widths for the two frequency bands. Much larger bandwidths (with BWRs of up to 4.0) can be realized using this horn design when compared to other approaches. The dual-band antenna may take the form of a single offset reflector, a dual reflector, or a dual reflector with beam-waveguide optics.

The previous description is provided to enable any person skilled in the art to practice the various aspects described herein. While the foregoing has described what are considered to be the best mode and/or other examples, it is understood that various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." Unless specifically stated otherwise, the term "some" refers to one or more. Pronouns in the masculine (e.g., his) include the feminine and neuter gender (e.g., her and its) and vice versa. Headings and subheadings, if any, are used for convenience only and do not limit the invention.

It is understood that the specific order or hierarchy of steps in the processes disclosed is an illustration of exemplary approaches. Based upon design preferences, it is understood that the specific order or hierarchy of steps in the processes may be rearranged. In some embodiments, some steps may be performed simultaneously. In some embodiments, steps may be omitted. The accompanying method claims present elements of the various steps in a sample order, and are not meant to be limited to the specific order or hierarchy presented.

Terms such as "top," "bottom," "front," "rear" and the like as used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference.

Standard geometric shapes such as cylinders are presumed to have known characteristics such as, in the case of a cylinder, an axis of symmetry, two ends, and a diameter.

A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. A phrase such an embodiment may refer to one or more embodiments and vice versa.

The word "exemplary" is used herein to mean "serving as an example or illustration." Any aspect or design described herein as "exemplary" is not necessarily to be construed as preferred or advantageous over other aspects or designs.

All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for." Furthermore, to the extent that the term "include," "have," or the like is used in the description or the claims, such term is intended to be inclusive in a manner similar to the term "comprise" as "comprise" is interpreted when employed as a transitional word in a claim.

What is claimed is:

1. A dual-band antenna system comprising:

a reflector; and a feed horn comprising:

a cylindrical region comprising a first end and a second end, wherein the first end has a connection for a waveguide carrying both a low-frequency signal in a first band and a high-frequency signal in a second band that is higher in frequency than the first band and does not overlap the first band; and a substantially conical second region comprising a first end that is coupled to the second end of the cylindrical region and an internal surface with a variable slope, one or more slope discontinuities disposed at separated locations along the internal surface, and one or more internal diameters at the respective locations of the slope discontinuities;

wherein the slope discontinuities and internal diameters are chosen to generate a low-frequency beam and a high-frequency beam that respectively have first and second beam widths that are approximately equal.

2. The dual-band antenna system of claim 1, wherein the antenna system is configured as a single reflector.

3. The dual-band antenna system of claim 1, wherein the antenna system is configured as a dual reflector with a sub-reflector and a main reflector.

4. The dual-band antenna system of claim 1, wherein the slope discontinuities and the respective internal diameters are chosen to reduce the efficiency of the high-frequency beam below 10%.

5. The dual-band antenna system of claim 1, wherein the cylindrical region comprises a length between the first and second ends and a diameter chosen to propagate a TE11 mode of the low-frequency beam.

6. The dual-band antenna system of claim 1, wherein the slope discontinuities and the respective internal diameters are chosen to produce higher-order TE1,*n* modes (n=2, 3, etc.) in the high-frequency beam so as to reduce the efficiency and increase the beam width of the high-frequency beam.

7. The dual-band antenna system of claim 1, wherein the 3 dB beam widths are approximately 0.4 degrees at both frequency bands.

8. The dual-band antenna system of claim 1, wherein the axial ratio is less than 2 dB.

9. The dual-band antenna system of claim 1, wherein the sidelobe levels at both bands are less than −25 dB relative to the peak gain.

10. A high/low efficiency feed horn comprising:

a connection surface configured for connection to a waveguide, wherein the waveguide is configured to carry signals in the range of 18-64 GHz;

an aperture;

a cylindrical segment with a inside diameter of approximately 0.39-0.47 inches and a length of 0.18-0.22 inches, connected at the first end to the connection surface; and a tapered segment of the general form of a truncated cone, wherein the narrow end of the truncated cone is connected to the second end of the cylindrical segment and the wide end of the truncated cone is connected to the aperture, comprising multiple sections connected in series:

a first conical section with an inside diameter at one end of 0.39-0.47 inches and an inside diameter at the other end of 0.40-0.61 inches and a length of 0.90-1.10 inches;

a second conical section with an inside diameter at one end of 0.40-0.61 inches and an inside diameter at the other end of 0.56-0.68 inches and a length of 0.99-1.21 inches;

a third conical section with an inside diameter at one end of approximately 0.56-0.68 inches and an inside diameter at the other end of 1.10-1.34 inches and a length of approximately 1.30-1.58 inches;

a fourth conical section with an inside diameter at one end of 1.10-1.34 inches and an inside diameter at the other end of 1.97-2.39 inches and a length of approximately 1.21-1.47 inches; and a fifth conical section with an inside diameter at one end of 1.97-2.39 inches and an inside diameter at the other end of 2.24-2.72 inches and a length of approximately 0.90-1.10 inches;

wherein each conical section is an approximately straight connection of the two end diameters and adjacent conical sections are joined by slope discontinuities.

11. The high/low efficiency feed horn of claim 10, wherein:

the cylindrical segment has a inside diameter of approximately 0.43 inches and a length of approximately 0.20 inches;

the first conical section has an inside diameter at one end of approximately 0.43 inches and an inside diameter at the other end of approximately 0.55 inches and a length of approximately 1.20 inches;

the second conical section has an inside diameter at one end of approximately 0.55 inches and an inside diameter at the other end of approximately 0.62 inches and a length of approximately 1.1 inches;

the third conical section has an inside diameter at one end of approximately 0.62 inches and an inside diameter at the other end of approximately 1.22 inches and a length of approximately 1.44 inches;

the fourth conical section has an inside diameter at one end of approximately 1.22 inches and an inside diameter at the other end of approximately 2.18 inches and a length of approximately 1.34 inches; and the fifth conical section has an inside diameter at one end of approximately 2.18 inches and an inside diameter at the other end of approximately 2.48 inches and a length of approximately 0.99 inches.

12. A dual-band feed horn comprising:

a connection surface configured for connection to a waveguide;

a first surface coupled to the connection surface, the first surface comprising a cylindrical surface having a length and a first diameter chosen to propagate TE11 modes for both a low-frequency band and a high-frequency band;

a second surface comprising a truncated cone with a first slope coupled to the first surface at a first slope discontinuity having the first diameter, wherein the first slope and first diameter are chosen to generate a TM12 mode in the high-frequency band;

a third surface comprising a truncated cone with a second slope coupled to the second surface at a second slope discontinuity having a second diameter, wherein the second slope and second diameter are chosen to generate a TM13 mode in the high-frequency band;

a fourth surface comprising a truncated cone with a third slope coupled to the third surface at a third slope discontinuity having a third diameter, wherein the third slope and third diameter are chosen to chosen to generate a TE12 mode in the low-frequency band and a TM15 mode in the high-frequency band;

a fifth surface comprising a truncated cone with a fourth slope coupled to the fourth surface at a fourth slope discontinuity having a fourth diameter, wherein the fourth slope and fourth diameter are chosen to chosen to generate a TE13 mode in the low-frequency band; and a sixth surface comprising a truncated cone with a fifth slope coupled to the fifth surface at a fifth slope discontinuity having a fifth diameter, wherein the fifth slope and fifth diameter are chosen to chosen to generate a TE14 mode in the low-frequency band and a TM16 mode in the high-frequency band; and an aperture coupled to the conical surface, wherein the slopes and diameters are chosen to generate primarily TE1,*m* modes (m=1, 2, 3, etc.) in the high-frequency band and primarily higher-order TE1,*n* modes (n=2, 3, etc.) in the low-frequency band such that the low-frequency band and the high-frequency band have approximately equal beam widths.

* * * * *